US005641600A

United States Patent [19]

Kotaki et al.

[11] Patent Number: 5,641,600

[45] Date of Patent: Jun. 24, 1997

[54] MAGNETIC TONER AND IMAGE FORMING METHOD

[75] Inventors: Takaaki Kotaki; Masaki Uchiyama; Yasutaka Akashi, all of Yokohama; Makoto Unno, Tokyo; Yushi Mikuriya; Tadashi Dojyo, both of Kawasaki, all of Japan

[73] Assignee: Canon Kabushiki Kaisha, Tokyo, Japan

[21] Appl. No.: 509,143

[22] Filed: Jul. 31, 1995

[30] Foreign Application Priority Data

Aug. 5, 1994 [JP] Japan ..... 6-203056
Aug. 5, 1994 [JP] Japan ..... 6-203058

[51] Int. Cl.[6] ..... G03G 9/083

[52] U.S. Cl. ..... 430/106.6; 430/122; 430/903

[58] Field of Search ..... 430/106.6, 903, 430/122

[56] References Cited

U.S. PATENT DOCUMENTS

| | | | |
|---|---|---|---|
| 2,221,776 | 11/1940 | Carlson . | |
| 2,297,691 | 10/1942 | Carlson . | |
| 2,618,552 | 11/1952 | Wise . | |
| 2,874,063 | 3/1959 | Greig . | |
| 3,666,363 | 5/1972 | Tanaka et al . | |
| 3,909,258 | 9/1975 | Kotz . | |
| 4,071,361 | 1/1978 | Marushima . | |
| 4,816,364 | 3/1989 | Oishi et al. | 430/106.6 |
| 4,898,801 | 2/1990 | Tachibana et al. | 430/106.6 |
| 4,975,214 | 12/1990 | Sakashita et al. | 430/106.6 |
| 4,977,053 | 12/1990 | Ohishi et al. | 430/106.6 |
| 5,143,810 | 9/1992 | Nozawa et al. | 430/106.6 |
| 5,180,650 | 1/1993 | Sacripante et al. | 430/126.6 |
| 5,338,894 | 8/1994 | Uchiyama et al. | 430/106.6 |

FOREIGN PATENT DOCUMENTS

| | | |
|---|---|---|
| 0400556 | 12/1990 | European Pat. Off. . |
| 0487230 | 5/1992 | European Pat. Off. . |
| 0622426 | 11/1994 | European Pat. Off. . |
| 55-18656 | 2/1980 | Japan . |
| 61-34070 | 2/1986 | Japan . |
| 62-278131 | 12/1987 | Japan . |
| 62-279352 | 12/1987 | Japan . |
| 3-9045 | 2/1991 | Japan . |
| 3-67265 | 3/1991 | Japan . |
| 4-362954 | 12/1992 | Japan . |
| 5-72801 | 3/1993 | Japan . |
| 5-213620 | 8/1993 | Japan . |

*Primary Examiner*—Roland Martin
*Attorney, Agent, or Firm*—Fitzpatrick, Cella, Harper & Scinto

[57] ABSTRACT

A magnetic toner composed of a binder resin and magnetic fine particles, wherein the magnetic fine particles are coated with an iron-zinc oxide on their surfaces and the magnetic fine particles have a saturation magnetization (σs) of 50 $Am^2/kg$ or above under a magnetic field of 79.58 kA/m (1K oersted) where the product of residual magnetization (σr, $Am^2/kg$) and coercive force (Hc, kA/m), σr×Hc, is in the range between 60 and 250 ($kA^2m/kg$).

40 Claims, 3 Drawing Sheets

MAGNETIC TONER AND IMAGE FORMING METHOD

BACKGROUND OF THE INVENTION

1. Field of the Invention

This invention relates to a magnetic toner for visualizing electrostatic latent images in an image forming process such as electrophotography and electrostatic recording. It also relates to an image forming method making use of such a magnetic toner.

2. Related Background Art

A number of methods are hitherto known for electrophotography, as disclosed in U.S. Pat. No. 2,297,691, Japanese Patent Publications No. 42-23910 (U.S. Pat. No. 3,666,363) and No. 43-24748 (U.S. Pat. No. 4,071,361) and so forth. In general, copies or prints are obtained as follows: an electrical latent image is formed on a photosensitive member by various means usually utilizing a photoconductive material, subsequently the latent image is developed with a toner into a visible image (a toner image), and the toner image is transferred to a transfer medium such as paper if necessary, and then the transferred image is fixed by heat, pressure or heat and pressure on the transfer medium.

Various developing methods to visualize the electrostatic latent images using a toner are also known. For example, there are magnetic brush development as disclosed in U.S. Pat. No. 2,874,063, cascade development as disclosed in U.S. Pat. No. 2,618,552, powder cloud development as disclosed in U.S. Pat. No. 2,221,776, fur brush development and liquid development. In these developing methods, the magnetic brush development, cascade development and liquid development, those employing a two component type developer mainly composed of a toner and a carrier, have been put to practical use. These methods are excellent in giving good images stably, but have common problems involved in the two component type developer, such as the deterioration of the carrier and change of the mixing ratio of the toner and the carrier.

To solve such problems, various developing methods employing one-component type developers comprised of a toner alone have been proposed. In particular, there are many superior methods in those employing a developer consisting of toner particles having magnetism.

U.S. Pat. No. 3,909,258 discloses a developing method employing a magnetic toner having an electric conductivity, where a conductive magnetic toner is held on a cylindrical conductive sleeve provided with a magnet inside thereof and the toner is brought into contact with electrostatic images to carry out development. In this development, in the developing zone, a conducting path is formed between the surface of the image-holding member and the surface of the sleeve via magnetic toner particles, and electric charges are led from the sleeve to the magnetic toner particles through the conducting path, and the magnetic toner particles adhere to the electrostatic image area by the coulomb force acting between the toner particles and the image area. Thus the electrostatic images are developed. This development using a conductive magnetic toner is a superior method which can avoid the problems involved in the conventional two-component type development. On the other hand, since the magnetic toner is conductive, there is a problem that it is difficult to electrostatically transfer the developed images from the image-holding member to the final transfer medium such as plain paper.

Among the developing methods employing a highly resistive magnetic toner that enables electrostatic transfer, there is a method utilizing dielectric polarization of magnetic toner particles. Such a method, however, has a problems that the development speed is substantially slow and the density of the developed images is not sufficient, thus practical use of it is difficult.

Other developing methods employing an insulating magnetic toner of high-resistivity are also known, in which magnetic toner particles are triboelectrically charged by the mutual friction between magnetic toner particles or by the friction between magnetic toner particles and the developing sleeve or the like and the toner particles thus charged come in contact with an electrostatic image-holding member to carry out development. Such methods, however, have problems in that the triboelectric charging tends to become insufficient because of the insufficient contact frequency between the magnetic toner particles and the friction member, or the charged magnetic toner particles tends to agglomerate on the sleeve because of the increasing coulomb force between the toner particles and the sleeve.

Japanese Patent Application Laid-open No. 55-18656 discloses novel jumping development that has solved the above problems, in which a magnetic toner is very thinly applied on a developing sleeve, and the toner thus applied is triboelectrically charged and brought very close to the electrostatic image to carry out development. According to this method, since the magnetic toner is very thinly applied on the developing sleeve, the contact opportunity between the developing sleeve and the magnetic toner increases enabling sufficient triboelectric charging, and also since the magnetic toner is supported by the magnetic force and the magnet and the magnetic toner are moved with respect to each other, the agglomeration of the toner particles is terminated and sufficient friction between the particles and the sleeve is achieved, whereby good images can be obtained.

However, the improved developing method employing such an insulating magnetic toner has an unstable factor due to the insulating magnetic toner used. That is, the toner contains a finely divided magnetic material mixed and dispersed in a considerable quantity and the magnetic material partly comes to the surfaces of toner particles. Hence, the properties of the magnetic material affect the fluidity and triboelectric chargeability of the magnetic toner, which consequently tend to affect various performances such as developing performance and running performance required for magnetic toners.

In the jumping development making use of a conventional magnetic toner, when the developing step (e.g., copying) is repeated for a long time, there are tendencies that the fluidity of the magnetic toner becomes lower, it is difficult to achieve normal triboelectric charging, the charging becomes non-uniform, and fogging occurs in an environment of low temperature and low humidity, thus problems occur in toner images. If the adhesion of binder resin and magnetic material that constitute magnetic toner particles is weak, the magnetic material may come off the surfaces of magnetic toner particles during the repetition of the developing step, adversely affecting the toner images, e.g., decreasing the image density.

When the magnetic material is not uniformly dispersed in the magnetic toner particles, the particles containing the magnetic material in a larger quantity and having a smaller particle diameter may accumulate on the developing sleeve, sometimes causing the decrease in image density and uneven image density called sleeve ghost.

Improvement on magnetic iron oxides to be contained in a magnetic toner has been attempted, but there is still room for further improvement.

For example, Japanese Patent Application Laid-open No. 3-67265 discloses a method to use spherical magnetic particles having a layer of a divalent metal oxide on the surface of a magnetic iron oxide particles. According to this method, in order to weaken the magnetic binding force and the magnetic cohesive force, the magnetic particles preferably have a relatively small coercive force, such as 40 to 70 oersted (3.2 to 5.6 kA/m) and also a small residual magnetization.

However, detailed studies made by the present inventors have revealed that, compared with hexahedral or octahedral particles, spherical magnetic particles when used in the magnetic toner invite increased abrasion of the photosensitive member surface because a larger amount of magnetic fine particles come to the magnetic toner particle surfaces due to the spherical particle shape.

Magnetic particles having small coercive force (Hc) and residual magnetization ($\sigma r$) have a weak magnetic binding force, and hence tend to cause fog especially in an environment of low humidity.

The reason why is considered as follows. In a development means employing a magnetic toner, usually a magnet having four or more magnetic poles is provided inside the developer-carrying member (developing sleeve). When the magnetic toner jumps from the developing sleeve to the photosensitive member to form a visible image on the photosensitive member, the driving force for jumping is the quantity of triboelectricity of the magnetic toner and the controlling force against jumping is the magnetic force of the magnetic particles. When the magnetic toner particles having a large saturation magnetization come near to the magnetic poles in the developing sleeve they have a large magnetic binding force sufficient enough to control the fog phenomenon. The magnetization, however, decreases when the magnetic toner particles come to the area between the magnetic poles in the developing sleeve. Hence it is impossible to control development by the saturation magnetization. Especially in an environment of low humidity, the quantity of triboelectricity of the magnetic toner increases, and hence it becomes easy for the magnetic toner to jump to the photosensitive member, so that fog tends to occur.

Magnetic material proposed in Japanese Patent Application Laid-open No. 3-67265 is prepared by slowly adding $Zn(OH)_2$ dropwise during the oxidation reaction. Hence, the product contains a considerable amount of zinc-iron oxide inside the magnetic particles. Also, because of the large zinc content and the ample presence of zinc component inside the magnetic particles, the magnetic properties (in particular, $\sigma r$ and Hc) are at low values. Moreover, since the zinc component is contained in a large quantity, the developed halftone image areas tend to be yellowish when the particle diameter of magnetic toner is made as small as 8 μm or less in weight average particle diameter.

Japanese Patent Applications Laid-open No. 62-279352 and No. 62-278131 disclose a magnetic toner containing a magnetic iron oxide incorporated with the silicon element. In such a magnetic iron oxide, the silicon element is intentionally positioned in the magnetic iron oxide, and there is room for further improvement in the fluidity of the magnetic toner containing the magnetic iron oxide.

In Japanese Patent Publication No. 3-9045, a silicate is added to make the shape of magnetic iron oxide spherical. In the magnetic iron oxide thereby obtained, the silicon element is distributed in a large quantity inside the magnetic iron oxide and less on the surface of the magnetic iron oxide, because of the silicate used for controlling the particle diameter, so that the improvement in fluidity of the magnetic toner tends to become insufficient.

Japanese Patent Application Laid-open No. 61-34070 discloses a process for producing triiron tetraoxide by adding a hydroxysilicate solution to triiron tetraoxide during oxidation reaction. The triiron tetraoxide particles obtained by this process have silicon element near the surface, but the silicon element is present in a layer structure near the surfaces of the triiron tetraoxide particles. Hence, there is the problem that the particle surfaces are weak to mechanical shock such as friction.

To solve the above problems, the present inventors have proposed in Japanese Patent Application Laid-open No. 5-72801 a magnetic toner containing magnetic iron oxide which contains the silicon element where 44 to 84% of the silicon element content is present on and near the surface of the magnetic material.

Such a magnetic iron oxide has brought about satisfactory improvements in the fluidity of toner and in the adhesion property to the binder resin. However, because of the local presence of silicon element on and near the surface of the magnetic iron oxide particles, such a toner tends to cause the deterioration of environmental properties, in particular, of charging property when left for a long period of time in an environment of high humidity.

Japanese Patent Application Laid-open No. 4-362954 also discloses a magnetic iron oxide containing both the silicon element and the aluminum element. There, however, is room for improvement in their environmental properties.

Japanese Patent Application Laid-open No. 5-213620 still also discloses a magnetic iron oxide containing a silicon component, where the silicon component is exposed on the surface. Like the foregoing, however, there is room for improvement in the environmental properties.

In recent years, with the digitalization of copying machines and the appearance of finer magnetic toners, higher image quality has been required for the copied images and printed images.

In copying a photographic picture containing letters, it is required that copied images of the letters are sharp and that of the picture image has a tone (image density gradation) faithful to the original. Generally, in copying a photographic picture containing letters, when the line density is increased in order to sharpen the letter images, the tone of the picture images will be damaged and also the halftone areas of the image tend to be coarse.

When the line density is increased, the amount of the magnetic toner laid on the image is so much that in the step of toner image transfer, the magnetic toner is pressed against the photosensitive member and adheres to the photosensitive member, causing what is called transfer hollow, a phenomenon caused by incomplete transfer of magnetic toner on the images, tending to provide copied images with a low image quality. On the other hand, improvement of the gradation of picture images results in a decrease in line (letter) image density, tending to decrease the sharpness.

In recent years, the tone reproduction has been improved to a certain extent by digital conversion of read image density. More improvement, however, is sought.

In addition, as the magnetic toner is made to have a smaller particle diameter, the surface area of magnetic toner per unit weight increases, which tends to bring about a broader charge distribution, thus fogging. As a result of the increase in the surface area of magnetic toner, the charging performance of the magnetic toner becomes susceptible to the influence of the environment.

When a magnetic toner has a smaller particle diameter, the dispersion states of the magnetic material and the colorant, and the magnetic properties or surface properties of the magnetic material come to affect the charging properties of magnetic toners.

Application of such a magnetic toner to a high-speed copying machine may lead to the excessive charging of the toner especially in an environment of low humidity, causing fog or the decrease of density.

It is sought to provide a magnetic toner that has overcome the various problems discussed above.

SUMMARY OF THE INVENTION

An object of the present invention is to provide a magnetic toner that has solved the problems discussed above.

Another object of the present invention is to provide a magnetic toner that can give a copied image or a print having a good quality even at the halftone area in spite of its small particle diameter, and applicable to from low- to high-speed copying machines and printers.

Still another object of the present invention is to provide a magnetic toner that can give copied images or prints of a high image density without fogging, which is applicable to from low- to high-speed copying machines and printers.

A further object of the present invention is to provide a magnetic toner that can give good images even in an environment of low humidity or of high humidity, without being affected by environmental variation.

A still further object of the present invention is to provide a magnetic toner that can give good images even when used in high-speed machines and applicable in a wide range of machine types.

A still further object of the present invention is to provide a magnetic toner that has a superior running performance, even in continues running for a long time, to give copied images of high image density without background fog.

A still further object of the present invention is to provide a magnetic toner that, in copying a photographic picture containing letters, can give sharp letter images while reproducing the picture images with a gradation faithful to the original.

A still further object of the present invention is to provide a magnetic toner that can promise a good charging performance and also a superior long-term storage stability, even in an environment of high humidity.

A still further object of the present invention is to provide an image forming method using the above magnetic toner.

To achieve the above objects, the present invention provides a magnetic toner comprising a binder resin and magnetic fine particles, wherein;

the magnetic fine particles are coated with iron-zinc oxide on their surfaces; and the magnetic fine particles have a saturation magnetization ($\sigma s$) of 50 $Am^2/kg$ or above under a magnetic field of 79.58 kA/m (1K oersted); the product of residual magnetization ($\sigma r$, $Am^2/kg$) and coercive force (Hc, kA/m), $\sigma r \times Hc$, being in the range between 60 and 250 ($kA^2m/kg$).

The present invention also provides an image forming method comprising;

forming an electrostatic image on an electrostatic latent image bearing member;

forming on the electrostatic latent image bearing member a developer layer having a magnetic toner;

triboelectrically charging the magnetic toner;

moving the triboelectrically charged magnetic toner to the surface of the electrostatic latent image bearing member to form a toner image on the electrostatic latent image bearing member;

transferring the toner image to a transfer medium via, or not via, an intermediate transfer medium; and fixing the toner image formed on the transfer medium; wherein;

the magnetic toner comprises a binder resin and magnetic fine particles, wherein;

the magnetic fine particles are coated with an iron-zinc oxide on their surfaces; and the magnetic fine particles have a saturation magnetization ($\sigma s$) of 50 $Am^2/kg$ or above under application of a magnetic field of 79.58 kA/m (1K oersted); the product of residual magnetization ($\sigma r$, $Am^2/kg$) and coercive force (Hc, kA/m), $\sigma r \times Hc$, being in the range between 60 and 250 ($kA^2m/kg$).

DESCRIPTION OF THE PREFERRED EMBODIMENTS

Figure 1:
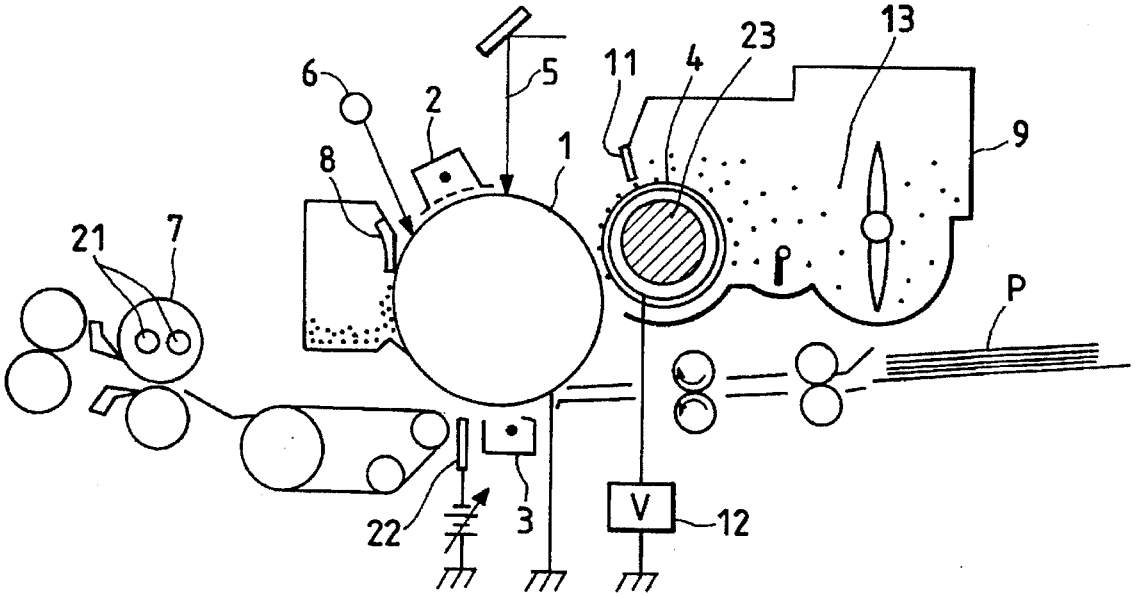
FIG. 1 is a schematic illustration of an example of an image forming system for carrying out the image forming method of the present invention.

The present inventors made extensive studies on the improvement of prevention of fog in an environment of low humidity. As a result, they have discovered that in order to control the flying force of magnetic toner positioned on the developing sleeve, out the magnet poles, it is preferable to use a fine particulate magnetic material of which product of residual magnetization ($\sigma r$) and coercive force (Hc), $\sigma r \times Hc$ is large. Further detailed studies have revealed the following. If the value of $\sigma r \times Hc$ is less than 60 $kA^2m/kg$ the force to control the flying of the magnetic toner positioned on the developing sleeve, out the magnet poles, may be lowered tending to cause fog especially in an environment of low humidity. If the value of $\sigma r \times Hc$ is more than 250 $kA^2m/kg$ the movement of magnetic toner on the developing sleeve, out the magnet poles, may be inhibited so that the quantity of triboelectric charge of the magnetic toner becomes small thus lowering the image density. In addition, if the saturation magnetization ($\sigma s$) is less than 50 $Am^2/kg$, the amount of the magnetic toner that can exist on the developing sleeve becomes small, decreasing the image density of the solid black area. Thus, it is difficult to satisfy both the tone and the letter line density as previously stated.

The zinc element present on or near the surfaces of magnetic fine particles can decrease the electrical resistance of the magnetic fine particles and provide a sharp distribution of the quantity of triboelectric charge of the magnetic toner, without lowering the magnetic properties of the magnetic fine particles. By reducing the electrical resistance of the magnetic fine particles, it becomes possible to prevent the magnetic toner from being excessively charged in an environment of low humidity.

When the value of $\sigma r \times Hc$ is in the range between 60 and 250 ($kA^2m/kg$), the movement of the magnetic toner positioned out the magnet poles on the developing sleeve is activated to increase the charging speed, so that the initial image density also becomes sufficiently high. Especially, even when an original is copied after the magnetic toner has been left in an environment of high humidity, the images having high image density and good quality can be obtained from the start. If the value of $\sigma r \times Hc$ is more than 250 $kA^2m/kg$, the mutual attraction force acting between magnetic toner particles becomes greater to decrease the opportunities of triboelectric charging of the magnetic toner particles positioned on the developing sleeve, out the magnet poles. Thus, the quantity of triboelectricity of the magnetic toner decreases resulting in a low initial image density. If the value of $\sigma r \times Hc$ is less than 60 $kAm^2/kg$, the mutual attraction force acting between magnetic toner particles becomes so small that the triboelectric charging of the magnetic toner particles may become weak, resulting in a low initial image density when the toner was left standing in an environment of high humidity.

In the magnetic toner of the present invention, more preferably the magnetic fine particles have a saturation magnetization ($\sigma s$) of 55 $Am^2/kg$ or above in a magnetic field of 79.58 kA/m (1K oersted) and the product of residual magnetization ($\sigma r$) and coercive force (Hc), $\sigma r \times Hc$, may be in the range between 80 and 210 ($kA^2m/kg$).

In order to make the present invention more effective, the residual magnetization ($\sigma r$) may be from 5 to 20 $Am^2/kg$, preferably from 8 to 18 $Am^2/kg$, and more preferably from 10.1 to 17 $Am^2/kg$, and the coercive force (Hc) may be from 6 to 16 kA/m, and preferably from 8 to 14 kA/m.

Total content of the zinc element may be in the range of from 0.05 to 3% by weight, and preferably from 0.1 to 1.6% by weight, based on the total iron element.

If the content of the zinc element is more than 3% by weight, the magnetic fine particles which should be black may be tinged with yellow, resulting in a decrease in blackness of copied images. Magnetic characteristics of the magnetic fine particles may also be lowered, tending to cause fog in an environment of low humidity. Moreover, the electrical resistance may become excessively low so that the quantity of triboelectricity of the magnetic toner will decrease, tending to cause a decrease in image density or a decrease in initial image density when the toner was left standing in an environment of high humidity. If the zinc content is less than 0.05% by weight, the addition of zinc becomes less effective.

Thus, the present inventors have discovered that by controlling the surface composition and magnetic properties of the magnetic fine particles, the toner can have superior environmental stability and superior long-term storage stability in an environment of high humidity in regard to charging performance, as well as the uniform distribution of the magnetic particles in the magnetic toner particles.

In the magnetic toner of the present invention, the ratio of the zinc element present in the portion of which dissolution of the iron element (%) is up to 10% by weight (i.e., the iron element dissolved from the portion is up to 10% by weight of the total iron) is preferably not less than 60% by weight, and more preferably not less than 70% by weight, of the total zinc content, since the iron-zinc oxide present in a large quantity on or near the surfaces of the magnetic fine particles play an important role in charging the magnetic toner as stated above.

As a more preferred mode, the magnetic fine particles may preferably be in the shape of hexahedrons or octahedrons. This is because such hexahedral or octahedral magnetic fine particles are not liable to come to the surface of the magnetic toner particle so that the abrasion or scratches of the photosensitive member hardly occurs. This is remarkably advantageous especially when the photosensitive member is electrostatically charged by a roller system.

The magnetic fine particles may also have an average particle diameter of from 0.05 to 0.35 μm, and preferably from 0.1 to 0.3 μm. If the magnetic fine particles have an average particle diameter smaller than 0.05 μm, the magnetic fine particles become reddish. If larger than 0.35 μm, the magnetic fine particles are non-uniformly dispersed in the toner particles, resulting in a broad distribution of the triboelectricity of the magnetic toner so that image deterioration such as fog is liable to occur.

It is preferred for the magnetic fine particles that the zinc element content of the portion of which dissolution of the iron element (%) is up to 10% by weight, is not less than 60% by weight of the total zinc element content, the silicon element content of that portion is not less than 70% by weight of the total silicon element content and also the content of the silicon element is larger than that of the zinc element.

Total content of the silicon element may also preferably be in the range of from 0.01 to 3% by weight, and more preferably from 0.05 to 2% by weight, based on the total amount of the iron element constituting the magnetic fine particles.

It is preferred that the surfaces of the magnetic fine particles has a double-layer structure comprised of a layer containing the silicon element in a large quantity and a layer containing the silicon element in a large quantity, and the latter is the surface layer.

Because of the outermost surface layer containing the silicon element in a large quantity, the magnetic particles present on the toner surface bring about an improvement in the fluidity and the charging performance of the magnetic toner. If the silicon element content in the top layer is less than 70% by weight, such improvements become small. The layer containing the zinc element in a large quantity contributes toward controlling the effects of the environmental changes, preventing the decrease of the image density and fogging due to over-charging in an environment of low humidity, as well as suppressing the decrease in the quantity of triboelectricity in an environment of high humidity.

If the silicon element is in a content smaller than that of the zinc element, the double-layer structure comprised of the upper layer containing the silicon element in a large quantity and the subsequent layer containing the zinc element in a large quantity becomes reverse, and becomes less effective in improving the toner fluidity by the silicon element. In addition, since the layer containing the silicon element in a large quantity positions inside, the controlling effect on the toner triboelectricity becomes small especially in an environment of high humidity, often resulting in a low image density.

The foregoing features are considered as follows. The stable chargeability of the magnetic toner is achieved since the silicon element in the surface layer is readily chargeable and the second layer can easily accept the charges generated in the surface layer due to the low resistivity of the second layer which is attributed to the zinc element. When the zinc element is present inside the silicon-containing layer without forming a layer in the magnetic particles, the initial image density tends to slightly decrease after the toner has been left for a long term in an environment of high temperature and high humidity, and also the density gradation does.

If the total silicon element content is less than 0.01% by weight based on the total iron element, the fluidity of the magnetic toner decreases and the chargeability of the magnetic toner becomes low. If it is more than 3% by weight, the charging performance deteriorates when the toner is left for a long term in an environment of high humidity.

The magnetic fine particles used in the present invention are produced, for example, by the following methods.

(A) To an aqueous solution containing the ferrous salt as the main component, an alkaline aqueous solution equivalent or more to the iron is added, and thereafter oxidation reaction is carried out at 70° to 90° C. while maintaining the concentration of free hydroxyl to 1–3 g/liter. After the oxidation reaction has been completed, a ferrous salt containing zinc is added to the mixture so that the weight ratio (% by weight) of Zn/Fe in the whole magnetic fine particles is in a range from 0.05 to 3% by weight (preferably from 0.1 to 1.6% by weight), pH is adjusted to 6.0 to 9.0, and the oxidation reaction is again carried out to the end. After the reaction has been completed, the reaction mixture is filtered and dried to obtain magnetic fine particles.

(B) To an aqueous solution containing the ferrous salt as the main component, an alkaline aqueous solution equivalent or more to the iron is added, and thereafter oxidation reaction is carried out at 70° to 90° C. while maintaining the concentration of free hydroxyl to 1–3 g/liter. After the oxidation reaction has been completed, a ferrous salt containing zinc is added to the mixture so that the weight ratio (% by weight) of Zn/Fe in the whole magnetic fine particles is in a range from 0.01 to 3% by weight, pH is adjusted to 6.0 to 9.0, and the oxidation reaction is again carried out to the end. After the oxidation reaction has been completed, a ferrous salt containing a silicate is added so that the weight ratio (% by weight) of Si/Fe in the whole magnetic fine particles is in a range from 0.01 to 3% by weight, pH is adjusted to 6.0 to 9.0, and the oxidation reaction is again carried out until the reaction is completed. After the reaction has been completed, the reaction mixture is filtered and dried to obtain magnetic fine particles.

The binder resin used in the present invention may preferably be mainly composed of a polyester resin or a vinyl resin.

A preferred polyester resin has the composition as shown below.

The polyester resin may preferably be comprised of an alcohol component holding 45 to 55 mol % and an acid component holding 55 to 45 mol %, of the whole components.

As the alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (I):

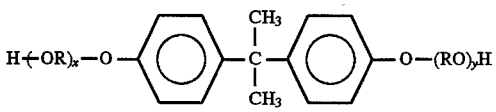

(I)

wherein R represents an ethylene group or a propylene group, x and y are each an integer of 1 or more, and an average value of x+y is 2 to 10;

and a diol represented by the following Formula (II):

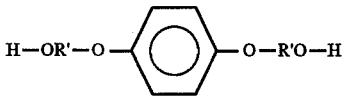

(II)

wherein R' represents

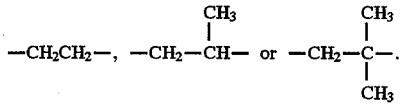

As a dibasic carboxylic acid holding 50 mol % or more in the whole acid components, it may include benzenedicarboxylic acids and anhydrides thereof, such as phthalic acid, terephthalic acid, isophthalic acid and phthalic anhydride; alkyldicarboxylic acids such as succinic acid, adipic acid, sebacic acid and azelaic acid, or anhydrides thereof; succinic acids substituted with an alkyl group or alkenyl group having 6 to 18 carbon atoms, or anhydrides thereof; and unsaturated dicarboxylic acids such as fumaric acid, maleic acid, citraconic acid and itaconic acid, or anhydrides thereof.

Also included are polyhydric alcohols such as glycerol, pentaerythritol, sorbitol, sorbitan and oxyalkylene ethers of novolak type phenol resin; and polybasic carboxylic acids such as trimellitic acid, pyromellitic acid, and benzophenonetetracarboxylic acid, or anhydrides thereof.

As a particularly preferred alcohol component in the polyester resin, it is the above bisphenol derivative represented by Formula (I). As the acid component, it may preferably include dicarboxylic acids such as phthalic acid, terephthalic acid, isophthalic acid or anhydrides thereof, succinic acid, n-dodecenylsuccinic acid, or anhydrides thereof, fumaric acid, maleic acid and maleic anhydride. As a cross-linking component, it may preferably include trimellitic anhydride, benzophenol tetracarboxylic acid, pentaerythritol, and oxyalkylene ethers of novolak type phenol resin.

The polyester resin may preferably have a glass transition temperature (Tg) of from 40° to 90° C., and more preferably from 45° to 85° C.; a number average molecular weight (Mn) of from 1,000 to 50,000, more preferably from 1,500 to 20,000, and still more preferably from 2,500 to 10,000; a weight average molecular weight (Mw) of from 3,000 to 3,000,000, more preferably from 10,000 to 2,500,000, and still more preferably from 40,000 to 2,000,000.

The polyester resin may preferably have an acid value of from 2.5 to 60 mg KOH/g, and more preferably from 10 to 50 mg KOH/g, and an OH value of 70 or less, preferably 60 or less, in view of good environment properties and a high charging rate.

In the present invention, two or more polyester resins having different composition, molecular weight, acid values and/or OH values may be mixed and used as the binder resin.

Vinyl monomers used to form the vinyl resin may include the following.

They can be exemplified by styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylene unsaturated monoolefins such as ethylene, propylene, butylene and isobutylene; unsaturated polyenes such as butadiene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; acrylic acid or methacrylic acid derivatives such as acrylonitrile, methacrylonitrile and acylamide; and esters of the α,β-unsaturated acids described above, and diesters of dibasic acids.

Also included are vinyl monomers having a carboxyl group as exemplified by unsaturated dibasic acids such as maleic acid, citraconic acid, itaconic acid, alkenylsuccinic acids, fumaric acid and mesaconic acid; unsaturated dibasic anhydrides such as maleic anhydride, citraconic anhydride, iraconic anhydride and alkenylsuccinic anhydrides; unsaturated dibasic acid half esters such as methylmaleic half ester, ethylmaleic half ester, butylmaleic half ester, methylcitraconic half ester, ethylcitraconic half ester, butylcitraconic half ester, methylitaconic half ester, methyalkenylsuccinic half esters, methylfumaric half ester and methylmesaconic half ester; unsaturated dibasic esters such as dimethyl maleate and dimethyl fumarate; α,β-unsaturated acids such as acrylic acid, methacrylic acid, crotonic acid and cinnamic acid; α,β-unsaturated anhydrides such as crotonic anhydride and cinnamic anhydride, or anhydrides of such α,β-unsaturated acids and lower fatty acids; alkenyl malonates, alkenyl glutarates, alkenyl adipates, acid anhydrides of these, and monoesters of these.

Still also included are vinyl monomers having a hydroxyl group as exemplified by acrylic or methacrylic esters such as 2-hydroxyethyl acrylate, 2-hydroxyethyl methacrylate and 2-hydroxypropyl methacrylate, 4-(1-hydroxy-1-methylbutyl)styrene, and 4-(1-hydroxy-1-methylhexyl) styrene.

The vinyl resin may have an acid value of 60 mg KOH/g or less, and preferably 50 mg KOH/g or less, and an OH value of 30 or less, and preferably 20 or less, in view of good environment properties.

This vinyl resin may have a glass transition temperature (Tg) of from 45° to 80° C., and preferably from 55° to 70° C.; a number average molecular weight (Mn) of from 2,500 to 50,000, and preferably from 3,000 to 20,000; a weight average molecular weight (Mw) of from 10,000 to 1,500,000, and preferably from 25,000 to 1,250,000.

A preferred binder resin may also have, in the measurement of its molecular weight distribution of tetrahydrofuran (THF)-soluble components, as measured by gel permeation chromatography (GPC), at least a peak in a low-molecular weight region of molecular weight of from 2,000 to 40,000, preferably from 3,000 to 30,000, and more preferably from 3,500 to 20,000, and a peak in a high-molecular weight region of molecular weight of from 50,000 to 1,200,000, preferably from 80,000 to 1,100,000, and more preferably from 100,000 to 1,000,000.

In the present invention, polyurethane, epoxy resin, polyvinyl butyral, rosin, modified rosin, terpene resin, phenol resin, an aliphatic or alicyclic hydrocarbon resin, an aromatic petroleum resin or the like may be optionally mixed in the binder resin described above.

The magnetic fine particles may be used in an amount of from 10 to 200 parts by weight, and preferably from 20 to 150 parts by weight, based on 100 parts by weight of the binder resin.

In the magnetic toner of the present invention for developing electrostatic images, a charge control agent may be optionally used to more stabilize the chargeability. The charge control agent may preferably be used in an amount of from 0.1 to 10 parts by weight, and more preferably from 0.1 to 5 parts by weight, based on 100 parts by weight of the binder resin.

The charge control agent may include the following.

For example, organic metal complexes or chelate compounds are effective. They may include monoazo metal complexes, metal complexes of aromatic hydroxycarboxylic acids, and metal complexes of aromatic dicarboxylic acids. Besides, they may include aromatic hydroxycarboxylic acids, aromatic mono- or polycarboxylic acids, and metal salts, anhydrides or esters thereof, as well as phenol derivatives such as bisphenol.

As colorants, carbon black, titanium white, and other pigments and/or dyes may be further used. For example, when the magnetic toner of the present invention is used as a magnetic color toner, the dyes include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4 and C.I. Basic Green 6. The pigments include chrome yellow, cadmium yellow, mineral first yellow, navel yellow, Naphthol Yellow S, Hanza Yellow G, Permanent Yellow NCG, Tartrazine Lake, chrome orange, molybdenum orange, Permanent Orange GTR, Pyrazolone Orange, Benzidine Orange G, cadmium red, Permanent Red 4R, Watchung Red calcium salt, eosine lake, Brilliant Carmine 3B, manganese violet, Fast Violet B, Methyl Violet Lake, prussian blue, cobalt blue, Alkali Blue Lake, Victoria Blue Lake, Phthalocyanine Blue, Fast Sky Blue, Indanthrene Blue BC, chrome green, chromium oxide, Pigment Green B, Malachite Green Lake and Final Yellow Green.

In the present invention, it is preferable for the magnetic toner particles to optionally contain at least one kind of release agent.

The release agent may include the following. That is, aliphatic hydrocarbon waxes such as low-molecular weight polyethylene, low-molecular weight polypropylene, microcrystalline wax and paraffin wax, oxides of aliphatic hydrocarbon waxes such as polyethylene wax oxide, and block copolymers of these; waxes mainly composed of a fatty acid ester, such as carnauba wax, sazol wax and montanic acid ester wax, or those obtained by subjecting part or the whole of a fatty acid ester to deoxidation treatment, such as deoxidized carnauba wax. It may also include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; fatty acid amides such as linolic acid amide, oleic acid amide and lauric acid amide; saturated fatty acid bisamides such as methylenebis(stearic acid amide), ethylenebis(capric acid amide), ethylenebis (lauric acid amide) and hexamethylenebis(stearic acid amide); unsaturated fatty acid bisamides such as ethylenebis (oleic acid amide), hexamethylenebis(oleic acid amide), N,N'-dioleyladipic acid amide and N,N'-dioleylsebacic acid amide; aromatic bisamides such as such as m-xylenebis (stearic acid amide) and N,N'-distearylisophthalic acid amide; fatty acid metal salts (commonly what is called metal soap) such as calcium stearate, calcium laurate, zinc stearate and magnesium stearate; grafted waxes obtained by grafting vinyl monomers such as styrene or acrylic acid to fatty acid hydrocarbon waxes; partially esterified products of polyhydric alcohols with fatty acids, such as monoglyceride behenate; and methyl esterified products having a hydroxyl group, obtained by hydrogenation of vegetable fats and oils.

The release agent particularly preferably used in the present invention may include aliphatic hydrocarbon waxes, as exemplified by low-molecular weight alkylene polymers obtained by radical polymerization of an alkylene under a high pressure or by polymerization thereof under a low pressure in the presence of a Ziegler catalyst; alkylene polymers obtained by thermal decomposition of a high-molecular weight alkylene polymer; and polymethylene hydrocarbon waxes obtained by hydrogenating the distillation residue of polymethylene hydrocarbons prepared by the Arge process from a synthesis gas containing carbon monoxide and hydrogen. Those obtained through fractionation of hydrocarbon waxes by a fractional crystallization system utilizing press-sweating, solvent dewaxing or vacuum distillation are preferably used. The hydrocarbon, serving as a matrix, may include polymethylene hydrocarbons synthesized by reacting carbon monoxide with hydrogen in the presence of a metal oxide type catalyst (usually two or more kinds of catalysts), as exemplified by hydrocarbons having about several hundred carbon atoms obtained by the Synthol method, the Hydrocol process using a fluidized catalyst bed or the Arge process using a fixed catalyst bed (this method provides mainly waxy hydrocarbons); and polyalkylene hydrocarbons obtained by polymerizing alkylenes such as ethylene in the presence of a Ziegler catalyst. These are preferable since they are saturated long straight chain hydrocarbons with less and shorter branches. In particular, waxes synthesized by the method not relying on the polymerization of alkylenes are preferred in view of their molecular weight distribution.

In the molecular weight distribution of the wax, there should be a peak in the region of molecular weight of from 400 to 2,400, preferably from 450 to 2,000, and particularly preferably from 500 to 1,600. The wax having such a molecular weight distribution can impart preferable thermal properties to the magnetic toner.

The release agent may preferably be added in an amount of from 0.1 to 20 parts by weight, and more preferably from 0.5 to 10 parts by weight, based on 100 parts by weight of the binder resin.

Any of these release agents is incorporated into the binder resin usually by a method that a resin is dissolved in a solvent and heated, and the release agent is added and mixed therein with stirring.

In the magnetic toner of the present invention, an inorganic fine powder or hydrophobic inorganic fine powder may preferably be contained. For example, it is preferable to use any of fine silica powder and fine titanium oxide powder alone or in combination.

The fine silica powder may be dry silica what is called dry process silica or fumed silica produced by vapor phase oxidation of silicon halides, or what is called wet silica produced from water glass or the like, either of which can be used. The dry silica is preferred, since it has less silanol groups on the surface and inside and is free from production residue.

The fine silica powder may preferably be those modified hydrophobic. For hydrophobic modification, it is preferable to chemically treat the silica powder with an organosilicon compound or the like which can react with or physically adsorbed by the fine silica powder. As a preferable method, a dry fine silica powder produced by vapor phase oxidation of a silicon halide is treated with a silane coupling agent and then or at the same time it is treated with a polymeric organosilicon compound such as silicone oil.

The silane coupling agent used in such hydrophobic treatment may include, for example, hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane and 1,3-diphenyltetramethyldisiloxane.

The polymeric organosilicon compound may include silicone oils. Silicone oils preferably used are those having a viscosity of from 30 to 1,000 centistokes at 25° C., preferably as exemplified by dimethyl silicone oil, methylphenyl silicone oil, α-methylstyrene modified silicone oil, chlorophenyl silicone oil, and fluorine modified silicone oil.

The treatment with silicone oil can be as follows. For example, the silicone oil and the fine silica powder treated with a silane coupling agent are directly mixed by means of a mixing machine such as a Henschel mixer, or the silicone oil is sprayed on the base fine silica powder. Alternatively, the silicone oil may be dissolved or dispersed in a suitable solvent and thereafter the solution or dispersion may be mixed with the base fine silica powder and then the solvent is removed.

One of the preferable treatment methods for making the fine silica powder hydrophobic is to treat the fine silica powder with dimethyldichlorosilane, subsequently with hexamethyldisilazane, and then with silicone oil.

It is particularly preferable to treat the fine silica powder with two or more kinds of silane coupling agents and thereafter with silicone oil as described above, because it can effectively increase the hydrophobicity.

In the present invention, it is also preferably used a fine titanium oxide powder subjected to the same hydrophobic modification treatment and the silicone oil treatment as mentioned above for the fine silica powder.

To the magnetic toner according to the present invention, external additives other than the fine silica powder may be optionally added. They are exemplified by fine particles serving as a charging auxiliary agent, a conductivity-providing agent, a fluidity-providing agent, an anti-caking agent, a release agent at the time of heat roll fixing, a lubricant, or an abrasive.

Such fine particles may include inorganic fine particles or organic fine particles, as exemplified by cerium oxide, silicon carbide and strontium titanate (in particular, strontium titanate is preferred) as an abrasive; titanium oxide and aluminum oxide as a fluidity-providing agent (in particular, hydrophobic ones are preferred); the anti-caking agent; carbon black, zinc oxide, antimony oxide and tin oxide as the conductivity-providing agent and white fine particles and black fine particles having a polarity opposite to that of the magnetic toner as the development improving agent.

The fine particles or hydrophobic inorganic fine particles can be mixed in the magnetic toner preferably in an amount of from 0.1 to 5 parts by weight, and more preferably from 0.1 to 3 parts by weight, based on 100 parts by weight of the magnetic toner.

The magnetic toner can be produced as follows/ The magnetic fine particles, the vinyl type or non-vinyl type thermoplastic resin, and optionally the pigment or dye serving as a colorant, the charge control agent and other additives are thoroughly mixed using a mixing machine such as a ball mill, thereafter the mixture is melt-kneaded by means of a heat kneading machine such as a heat roll, a kneader or an extruder to make a molten mixture in which the pigment or dye is dispersed or dissolved, and then the melt-kneaded product is cooled to solidify, followed by pulverization and precise classification. Thus the magnetic toner according to the present invention can be obtained.

The magnetic toner may preferably have a weight average particle diameter of from 3 to 8 μm in view of resolution and halftone reproduction.

Measurement of the respective properties of the magnetic fine particles will be described below.

(1) Measurement of zinc element content and silicon element content:

For the sample of a magnetic toner, the binder resin is dissolved using a suitable solvent and the magnetic fine particles are collected by means of a magnet. This operation is repeated several times to wash away the binder resin adhering to the surfaces of the magnetic fine particles, and the resulting particles are used as a sample.

In the present invention, the contents of the zinc element and the silicon element in the magnetic fine particles (e.g., magnetic fine iron oxide particles) can be determined in the following way. For example, about 3 liters of deionized water is put in a 5-liter beaker, and then heated in a water bath up to 50° to 60° C. About 25 g of magnetic fine particles is made into a slurry with about 400 ml of deionized water and the slurry is washed into the above 5-liter beaker with about 300 ml of additional deionized water.

Subsequently, maintaining the temperature at 50° C. and the stirring speed at 200 rpm, the hydrochloric acid of special grade is added to start dissolution. At this point, the concentration of magnetic iron oxide is 5 g/liter and the concentration of the hydrochloric acid is 3N. From the start of dissolution to the point of the dissolution completion when the solution becomes transparent, about 20 ml of the solution are sampled several times, and filtered with a 0.2 μm membrane filter to collect the filtrate. The filtrate is subjected to inductively coupled plasma (ICP) spectroscopy to quantitatively determine the iron element, the silicon element and the zinc element.

The dissolution of the iron element of a sample is calculated according to the following expression. Dissolution of the iron element (%)=

$$\frac{\text{Iron element conc. (mg/lit) in filtrate}}{\text{Iron element concentration (mg/lit) after complete dissolution}} \times 100$$

Similarly, the silicon element content and zinc element content for each sample are determined according to the following expression.

Silicon element content (%) =

$$\frac{\text{Silicon element conc. (mg/lit) in filtrate}}{\text{Silicon element concentration (mg/lit) after complete dissolution}} \times 100$$

Zinc element content (%) =

$$\frac{\text{Zinc element conc. (mg/lit) in filtrate}}{\text{Zinc element concentration (mg/lit) after complete dissolution}} \times 100$$

Figure 3:
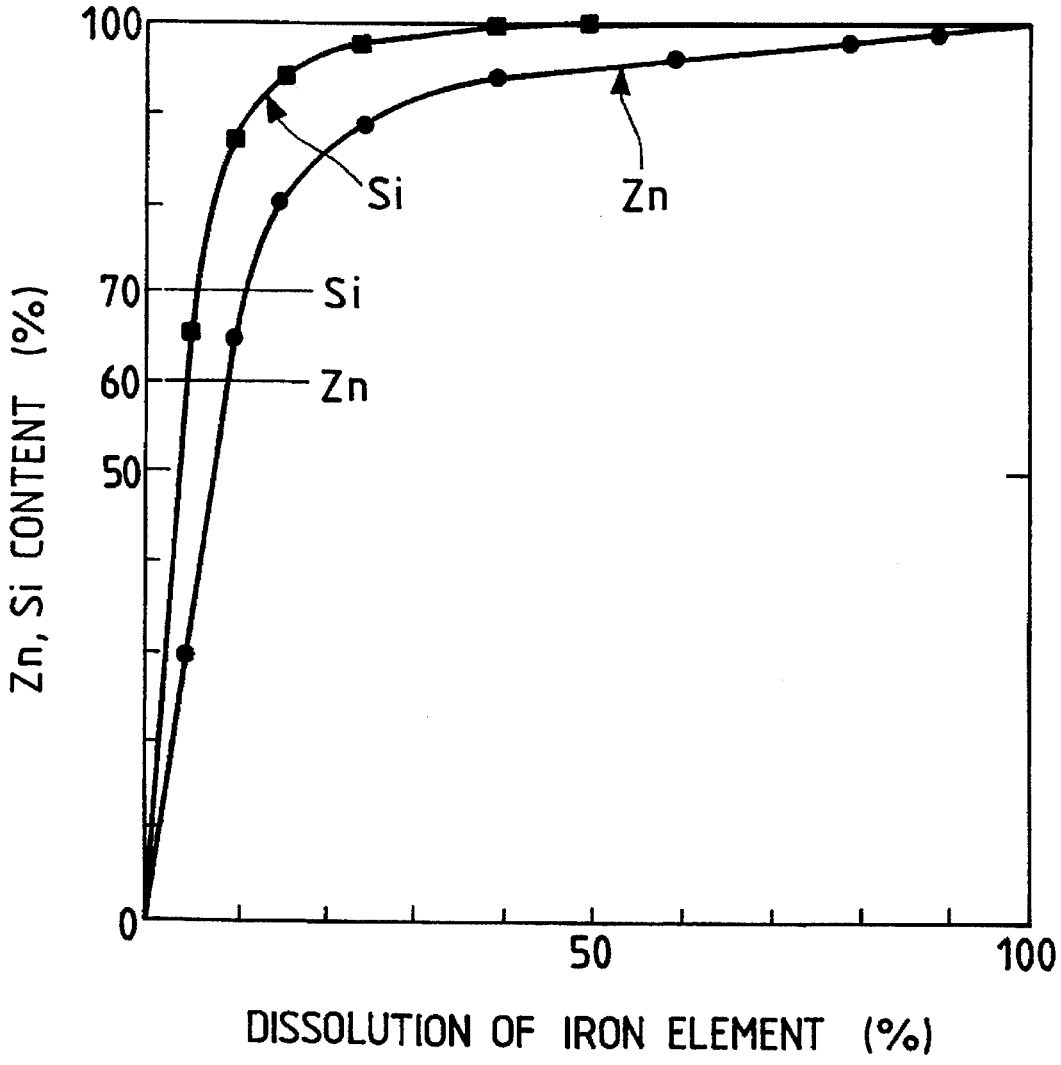
FIG. 3 is a graph to show the relationship between the dissolution of the iron element (%) and the contents of zinc and silicon elements.

As shown in FIG. 3, the dissolution of the iron element (%) to the silicon element content and the dissolution of the iron element (%) to the zinc element content are plotted to obtain curves. From this figure, the silicon element content and zinc element content at the dissolution of the iron element of 10% by weight are each read and regarded as the contents referred to in the present invention.

The total silicon element content and total zinc element content based on the total iron element are determined according to the following expression.

Total silicon content =

$$\frac{\text{Silicon element concentration (mg/lit) after complete dissolution}}{\text{Iron element concentration (mg/lit) after complete dissolution}} \times 100$$

Total zinc content =

$$\frac{\text{Zinc element concentration (mg/lit) after complete dissolution}}{\text{Iron element concentration (mg/lit) after complete dissolution}} \times 100$$

(2) Measurement of magnetic properties (σs σr, Hc) of magnetic fine particles:

The magnetic toner is sampled and the magnetic particles are collected in the same manner as in the measurement (1) and used as a sample.

Magnetic properties of the magnetic fine particles mean the values obtained by measurement using, for example, VSMP-1, manufactured by Toei Kogyo K.K. In the measurement of magnetic properties, 0.1 to 0.15 g of the magnetic fine particles are precisely weighed by means of a direct-reading balance with a sensitivity of about 1 mg to obtain a sample. The measurement is carried out at a temperature of about 25° C. In determining the magnetic properties, the external magnetic field is set at 79.58 kA/m (1 k oersted), and the sweep rate in drawing hysteresis loops, at 10 minutes.

(3) Measurement of average particle diameter of magnetic fine particles:

The magnetic toner is sampled and the magnetic particles are collected in the same manner as in the measurement (1) and used as a sample.

A transmission electron microscope photograph of magnetic fine particles is projected with a magnification of ×40,000, from which 250 particles are randomly selected. Then, for each projected particles, the Martin diameter (the length of a segment that bisects the projected area in a given direction) is measured to calculate the number average diameter.

(4) Measurement of resistivity of magnetic fine particles:

In the present invention, volume resistivity of the magnetic fine particles is measured in the following way.

Magnetic fine particles (10 g) are put in a measuring cell, and molded by means of an oil-pressure cylinder (pressure: 600 kg/cm$^2$). After releasing the pressure, a resistivity meter (YEW MODEL 2506A DIGITAL MALTIMETOR, manufactured by Yokogawa Electric Works, Ltd.) is set, and then a pressure of 150 kg/cm$^2$ is again applied by means of the oil-pressure cylinder. A voltage of 10 V is applied to start the measurement, and measurements after 3 minutes are read. The thickness of the sample is also measured to calculate the volume resistivity according to the following expression.

$$\text{Volume resistivity } (\Omega \cdot \text{cm}) = \frac{\text{Measured resistivity } (\Omega) \times \text{Sample sectional area } (\text{cm}^2)}{\text{Sample thickness (cm)}}$$

Figure 2:
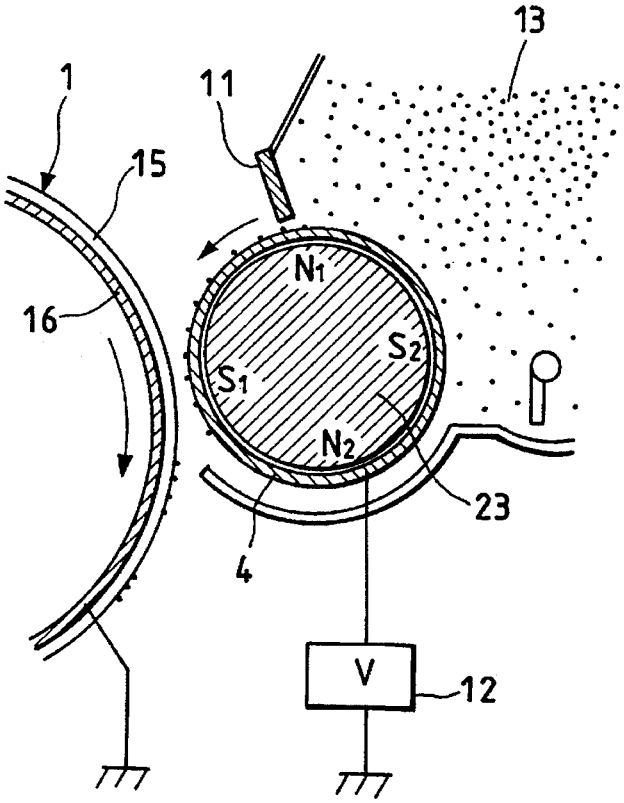
FIG. 2 is an enlarged view of the developing area of the system shown in FIG. 1.

The image forming method of the present invention will be described below with reference to FIGS. 1 and 2.

The surface of an electrostatic image bearing member (a photosensitive member) 1 is negatively or positively charged by a primary charger 2, and exposed to laser light 5 to form an electrostatic image (e.g., form a digital latent image by image scanning). The electrostatic image thus formed is developed by reversal development or usual development using a magnetic toner 13 which is held in a developing assembly 9 equipped with a magnetic blade 11 and a developer carrying member (a developing sleeve) 4 internally provided with a magnet 23 having magnetic poles N1, N2, S1 and S2. In the developing zone, an alternating bias, a pulse bias and/or a DC bias is/are applied across a conductive substrate 16 and the developing sleeve 4 through a bias applying means 12. A magnetic toner image is transferred to a transfer medium via, or not via, an intermediate transfer medium. Transfer paper P is fed and delivered to the transfer zone, where the transfer paper P is positively or negatively electrostatically charged by a transfer charger 3 from its back surface (the surface opposite to the photosensitive member), so that the negatively charged or positively charged toner image on the surface of the photosensitive member is electrostatically transferred to the transfer paper P. After charge elimination by a charge eliminating means 22, the transfer paper P separated from the photosensitive member 1 is subjected to fixing using a heat-pressure roller fixing assembly 7 internally provided with a heater 21, so that the toner image on the transfer paper P is fixed.

The magnetic toner remaining on the photosensitive member 1 after the step of transfer is removed by the operation of a cleaning means having a cleaning blade 8. After the cleaning, the residual charges on the surface of the photosensitive member 1 is eliminated by erase exposure 6, and thus the procedure again starts from the charging step using the primary charger 2.

The electrostatic latent image bearing member (e.g., the photosensitive member) 1 comprises a photosensitive layer 15 and a conductive substrate 16, and is rotated in the direction of the arrow. In the developing zone, the developing sleeve 4 formed of a non-magnetic cylinder, which is a toner carrying member, is rotated in the same direction as the rotation direction of the electrostatic latent image bearing member 1. Inside the non-magnetic, cylindrical developing sleeve 4, a multi-polar permanent magnet 4 (magnet roll) serving as a magnetic field generating means is provided in an unrotatable state. The magnetic toner 13 held in the developing assembly 9 is applied on the surface of the developing sleeve, and triboelectric charges are imparted to the magnetic toner particles on account of friction with the surface of the developing sleeve 4. A magnetic doctor blade 17 made of iron is also disposed in proximity (distance: 50 μm to 500 μm) to the surface of the cylindrical developing sleeve 4. Thus, the thickness of magnetic toner layer is controlled to be small (30 μm to 300 μm) and uniform so that a magnetic toner layer with a thickness equal to or smaller than the gap between the photosensitive member 1 and the developing sleeve 4 in the developing zone is formed. The rotational speed of this developing sleeve 4 is regulated so that the peripheral speed of the developing sleeve can be substantially equal or close to the peripheral speed of the photosensitive member. As the magnetic doctor blade, a permanent magnet may be used in place of iron to form an opposing magnetic pole. In the developing zone, an AC bias or a pulse bias may be applied to the developing sleeve 4 through a bias means 12. This AC bias may have a frequency (f) of from 200 to 4,000 Hz and a Vpp of from 500 to 3,000 V.

When the magnetic toner particles are moved in the developing zone, the magnetic toner particles move to the side of the electrostatic image by the electrostatic force of the surface of the photosensitive member and the action of the AC bias or pulse bias.

The magnetic toner may be applied on the developing sleeve, using an elastic doctor blade formed of an elastic material such as silicone rubber in place of the magnetic blade 11 to control the thickness of the magnetic toner layer by pressing.

The present invention will be described below in greater detail by giving Production Examples for the magnetic fine particles and Examples of the magnetic toner.

In the following examples, "part(s)" or "%" refers to "part(s) by weight" or "% by weight", respectively.

MAGNETIC FINE PARTICLES

PRODUCTION EXAMPLE 1

First, 65 liters of an aqueous ferrous sulfate solution containing 1.5 mol/liter of $Fe^{2+}$ and 88 liters of an aqueous 2.4N sodium hydroxide solution were mixed and stirred.

The concentration of the residual sodium hydroxide in the mixed aqueous solution was adjusted to 4.2 g/liter. Thereafter, maintaining the temperature at 80° C., 30 liter/minute of air was blown into the solution to terminate the reaction.

Next, zinc sulfate was added in an aqueous ferrous sulfate solution containing 1.3 mol/liter of $Fe^{2+}$, to prepare 2.25 liters of an aqueous solution containing $Zn^{2+}$ in a concentration of 0.5 mol/liter, which was added to the above reaction slurry. Then, 15 liter/minute of air was blown into it to terminate the reaction.

Subsequently, sodium silicate (No. 3) was added in an aqueous ferrous sulfate solution containing 1.01 mol/liter of $Fe^{2+}$ to prepare 2.3 liters of an aqueous solution containing $Si^{4+}$ in a concentration of 0.44 mol/liter, which was added to the above reaction slurry. Then, 15 liter/minute of air was blown into it, and the reaction was completed.

The magnetic fine particles thus obtained were treated through conventional steps of washing, filtration, drying and disintegration.

Properties of the magnetic fine particles are shown in Table 1.

MAGNETIC FINE PARTICLES

PRODUCTION EXAMPLES 2 to 9

Production Example 1 was repeated except for changing the amount of zinc and the reaction conditions, to give magnetic fine particles having the properties as shown in Table 1.

MAGNETIC FINE PARTICLES

COMPARATIVE PRODUCTION EXAMPLE 1

Production Example 1 was repeated except for adding neither zinc nor silicon, to give magnetic fine particles having the properties shown in Table 1.

MAGNETIC FINE PARTICLES

COMPARATIVE PRODUCTION EXAMPLES 2 to 4

Conditions in production Example 1 were changed for the amount of zinc and silicon added, the manner of addition, the pH of the reaction system, the reaction time and the reaction temperature, to obtain magnetic fine particles having the properties as shown in Table 1.

TABLE 1

| | Properties of Magnetic Fine Particles | | | | | | | | | | |
|---|---|---|---|---|---|---|---|---|---|---|---|
| | Magnetic properties | | | | | | | | | | |
| | Saturation magnetization σs ($Am^2/kg$) | Residual magnetization σr ($Am^2/kg$) | Coercive force Hc (KA/m) | The product of σr and Hc (σr × Hc) | Total zinc content (%)* | *1 Zinc content (%)** | Total silicon content (%)* | *1 Silicon content (%)*** | Average particle diameter (μm) | Shape | Resistivity (Ω · cm) |
| Production Example: | | | | | | | | | | | |
| 1 | 61.2 | 13.0 | 10.2 | 133 | 1.4 | 81 | 0.5 | 95 | 0.2 | Octahedron | $1.2 \times 10^3$ |
| 2 | 57.0 | 15.8 | 13.0 | 205 | 1.6 | 72 | 0.05 | 82 | 0.17 | Octahedron | $9.2 \times 10^2$ |
| 3 | 62.5 | 10.2 | 8.2 | 84 | 0.1 | 80 | 0.8 | 90 | 0.21 | Octahedron | $4.0 \times 10^3$ |
| 4 | 53.0 | 9.0 | 7.2 | 65 | 1.2 | 77 | 1.5 | 85 | 0.22 | Octahedron | $8.9 \times 10^2$ |
| 5 | 60.0 | 16.7 | 13.2 | 220 | 1.3 | 82 | 1.7 | 93 | 0.14 | Octahedron | $8.7 \times 10^2$ |
| 6 | 63.0 | 12.7 | 10.1 | 128 | 0.06 | 70 | 2.5 | 82 | 0.20 | Octahedron | $4.8 \times 10^3$ |
| 7 | 59.0 | 11.5 | 9.0 | 104 | 2.5 | 72 | 1.0 | 92 | 0.21 | Octahedron | $8.0 \times 10^2$ |
| 8 | 62.5 | 14.5 | 11.3 | 164 | 3.5 | 62 | 0.7 | 77 | 0.18 | Octahedron | $7.8 \times 10^2$ |
| 9 | 61.0 | 13.7 | 11.0 | 151 | 1.4 | 65 | 3.5 | 73 | 0.19 | Octahedron | $3.8 \times 10^3$ |
| Comparative Production Example: | | | | | | | | | | | |
| 1 | 65.5 | 14.0 | 12.0 | 168 | — | — | — | — | 0.19 | Octahedron | $4.4 \times 10^4$ |
| 2 | 67.5 | 17.5 | 15.5 | 271 | 1.5 | 80 | 1.0 | 90 | 0.07 | Octahedron | $5.0 \times 10^4$ |
| 3 | 65.0 | 8.2 | 5.9 | 48 | 5.0 | 50 | 4.0 | 60 | 0.21 | Octahedron | $6.0 \times 10^4$ |
| 4 | 65.3 | 8.5 | 6.0 | 51 | 6.0 | 70 | 5.0 | 80 | 0.21 | Sphere | $8.3 \times 10^4$ |

*based on total iron element
**based on total zinc element
***based on total silicon element
*1: until 10% dissolution of iron element

EXAMPLE 1

Polyester resin 100 parts (obtained by condensation polymerization of terephthalic acid, fumaric acid, succinic acid, the bisphenol represented by Formula (I), having an ethylene group, and the bisphenol represented by Formula (I), having a propylene group; acid value: 25; OH value: 10; Mn: 4,500; Mw: 65,000; Tg: 58° C.)

Magnetic fine particles in Production Example 1 100 parts

Low-molecular weight ethylene-propylene copolymer (release agent) 3 parts

Monoazo metal complex (negative charge control agent) 1 part

The above materials were thoroughly premixed using a Henschel mixer, and then melt-kneaded at 130° C. using a twin-screw extruder. The kneaded product thus obtained was cooled, and then crushed with a cutter mill. Thereafter the crushed product was finely pulverized by a fine grinding mill utilizing a jet stream. Subsequently, the finely pulverized powder obtained was classified using an air classifier to obtain a negatively chargeable insulating magnetic toner with a weight average particle diameter of 6.2 μm. To 100 parts of the magnetic toner thus obtained, 1.0 part of hydrophobic dry fine silica particles (BET surface specific area: 300 $m^2/g$) were externally added using a Henschel mixer to obtain a negatively chargeable magnetic toner having the hydrophobic dry fine silica particles on the magnetic toner particle surfaces.

The negatively chargeable magnetic toner thus obtained was applied to a digital copying machine (GP-55) manufactured by Canon Inc.), and images were reproduced in an environment of normal temperature and low humidity (23.5° C./15% RH; N/L) and an environment of high temperature and high humidity (35° C./90% RH; H/H) to evaluate the image quality.

Results obtained are shown in Table 3.

In the digital copying machine, a photosensitive drum of an aluminum cylinder with 30 mm diameter having thereon an OPC photosensitive layer was charged to −700 V by a primary charger. Digital latent images were formed by image scanning with laser light, and then reversal-developed using the negatively chargeable insulating magnetic toner triboelectrically charged by a developing sleeve internally provided with a stationary magnet having four magnetic poles (development magnetic poles having 950 gauss). To the developing sleeve, a DC bias of −600 V and an AC bias of Vpp 800 V (1,800 Hz) were applied. Magnetic toner images on the photosensitive drum were electrostatically transferred to plain paper through a transfer means. After elimination of charges of the plain paper, the plain paper was separated from the photosensitive drum, and then the magnetic toner images on the plain paper was fixed through a heat and pressure means having heating rollers and pressure rollers.

EXAMPLE 2

A negatively chargeable insulating magnetic toner was obtained in the same manner as in Example 1 except that the polyester resin was replaced with 100 parts of a styrene/butyl acrylate copolymer (Mn: 12,000; Mw: 250,000; having peaks at 7,000 and 330,000 in its molecular weight distribution; Tg: 59° C.).

This negatively chargeable insulating magnetic toner was tested in the same manner as in Example 1 to make an evaluation.

Results obtained are shown in Table 3.

EXAMPLES 3 to 10

Negatively chargeable insulating magnetic toners were obtained in the same manner as in Example 1 except for changing the compositions of magnetic toners to those shown in Table 2. These negatively chargeable insulating magnetic toners obtained were tested in the same manner as in Example 1 to make an evaluation.

Results obtained are shown in Table 3.

COMPARATIVE EXAMPLES 1 to 4

Negatively chargeable insulating magnetic toners were obtained in the same manner as in Example 1 except for changing the compositions of magnetic toners to those shown in Table 2. These negatively chargeable insulating magnetic toners obtained were tested in the same manner as in Example 1 to make an evaluation.

Results obtained are shown in Table 3.

TABLE 2

| | Binder resin | Magnetic fine particles | Magnetic toner weight average particle diameter (μm) |
|---|---|---|---|
| Example: | | | |
| 1 | Polyester resin | Production Example 1 | 6.2 |
| 2 | Styrene/butyl acrylate copolymer | Production Example 1 | 6.2 |
| 3 | Polyester resin | Production Example 2 | 6.5 |
| 4 | Polyester resin | Production Example 3 | 6.3 |
| 5 | Polyester resin | Production Example 4 | 6.6 |
| 6 | Polyester resin | Production Example 5 | 6.4 |
| 7 | Polyester resin | Production Example 6 | 6.0 |
| 8 | Polyester resin | Production Example 7 | 6.3 |
| 9 | Polyester resin | Production Example 8 | 6.5 |
| 10 | Polyester resin | Production Example 9 | 6.4 |
| Comparative Example: | | | |
| 1 | Polyester resin | Comp. Production Ex. 1 | 6.2 |
| 2 | Polyester resin | Comp. Production Ex. 3 | 6.4 |
| 3 | Polyester resin | Comp. Production Ex. 4 | 6.6 |
| 4 | Polyester resin | Comp. Production Ex. 5 | 6.8 |

TABLE 3(A)

| | Results of Evaluation | | | | | | | | |
|---|---|---|---|---|---|---|---|---|---|
| | After 10,000 sheet copying in N/L environment | | | | | | | | |
| | Quantity of triboelectricity (μC/g) | Solid black area maximum density | Density gradation | Line image quality | Halftone area: Image quality (coarseness) | Halftone area: Tinge | White background fog | Photosensitive drum: Abration (μm) | Photosensitive drum: Scratch |
| Example: | | | | | | | | | |
| 1 | −16.0 | A (1.50) | A | A | A | A (Black) | A | A (1.6) | A (None) |
| 2 | −15.0 | A (1.47) | A | A | A | A (Black) | AB | A (1.7) | A (None) |
| 3 | −18.0 | A (1.47) | A | A | A | A (Black) | A | A (1.7) | A (None) |
| 4 | −22.0 | A (1.45) | A | A | A | A (Black) | A | A (1.8) | A (None) |
| 5 | −20.0 | AB (1.38) | AB | A | A | A (Black) | AB | A (1.4) | A (None) |
| 6 | −16.0 | A (1.40) | A | A | A | A (Black) | A | A (1.7) | A (None) |
| 7 | −15.0 | AB (1.38) | AB | A | A | A (Black) | A | A (1.8) | A (None) |
| 8 | −17.0 | AB (1.38) | AB | A | A | A (Black) | A | A (1.7) | A (None) |

TABLE 3(A)-continued

| | Results of Evaluation | | | | | | | |
|---|---|---|---|---|---|---|---|---|
| | After 10,000 sheet copying in N/L environment | | | | | | | |
| | Quan-* tity of tribo-elec-tricity (μC/g) | Solid black area maximum density | Den-sity grada-tion | Line image qual-ity | Halftone area: Image quality (coarse-ness) | Halftone area: Tinge | White back-ground fog | Photosensitive drum: Abration (μm) | Photosensitive drum: Scratch |
| 9 | −13.0 | AB (1.38) | AB | A | A | AB (Slightly yellowish) | A | A (1.8) | A (None) |
| 10 | −13.5 | AB (1.38) | AB | A | A | A (Black) | AB | A (1.9) | A (None) |
| Comparative Example: | | | | | | | | | |
| 1 | −30.0 | B (1.30) | BC | B | BC | A (Black) | BC | AB (2.2) | A (None) |
| 2 | −4.0 | B (1.30) | BC | BC | B | A (Black) | A | AB (2.3) | A (None) |
| 3 | −3.5 | B (1.30) | BC | BC | C | BC (Yellowish) | C | AB (2.4) | A (None) |
| 4 | −4.5 | AS (1.35) | AB | A | C | BC (Yellowish) | C | C (3.7) | C (7 lines) |

*of magnetic toner

TABLE 3(B)

| | Results of Evaluation | | | | | | | |
|---|---|---|---|---|---|---|---|---|
| | Evaluation of initial image quality after leaving for a week in H/H environment | | | | | | | |
| | Quan-* tity of tribo-elec-tricity (μC/g) | Solid black area maximum density | Den-sity grada-tion | Line image qual-ity | Halftone area image quality | White back-ground fog | Properties of magnetic toner: Fluidity | Properties of magnetic toner: Charging Rate |
| Example: | | | | | | | | |
| 1 | −13.0 | A (1.45) | A | A | A | A | A | A |
| 2 | −12.0 | A (1.42) | A | A | A | A | A | A |
| 3 | −13.0 | A (1.40) | A | A | A | A | A | A |
| 4 | −18.0 | A (1.42) | A | A | A | A | A | A |
| 5 | −14.0 | AB (1.36) | AB | A | A | A | A | A |
| 6 | −13.0 | AB (1.36) | AB | A | A | A | AB | AB |
| 7 | −12.0 | A (1.40) | A | A | A | A | A | A |
| 8 | −13.0 | A (1.40) | A | A | A | A | A | A |
| 9 | −10.0 | AB (1.38) | AB | A | A | A | AB | AB |
| Comparative Example: | | | | | | | | |
| 10 | −10.0 | AB (1.35) | AB | A | A | AB | AB | AB |
| 1 | −3.0 | B (1.25) | BC | B | BC | B | BC | BC |
| 2 | −1.0 | BC (1.20) | C | BC | BC | AB | AB | C |
| 3 | −1.0 | BC (1.20) | C | BC | BC | C | BC | BC |
| 4 | −1.5 | B (1.25) | BC | B | B | B | A | A |

*of magnetic toner

The evaluation was made in the manner as shown below.

(1) Images were evaluated according to five ranks of A: good; AB: a little good; B: average; BC: a little poor; and C: Poor.

(2) Solid black area maximum image density (the maximum image density at the solid black areas free of edge effect) was measured using Macbeth RD918 (manufactured by Macbeth Co.)

(3) To examine tinges of halftone areas, images with a density of about 0.4 to 0.8 were reproduced to make a visual evaluation.

(4) Abrasion of the surface of the drum photosensitive member were examined by measuring the surface layer thickness of the photosensitive member, utilizing eddy currents. Scratches were judged by whether the scratch marks appearing on images agree with the scratches on the drum surface of the photosensitive member.

(5) Fluidity of the magnetic toner was measured in the following way.

A sample (2 g) of the magnetic toner is weighed. Three sieves of 60 mesh, 100 mesh and 200 mesh are set in Powder Tester (Hosokawa Micron K.K.) in the descending order and 2 g of the sample previously weighed is gently put on the uppermost sieve, followed by vibration with an amplitude of 1 mm for 65 seconds. Then the weight of magnetic iron oxide remained on the respective sieves is measured and the fluidity is calculated according to the following expression.

$$\text{Fluidity} = \frac{(\text{Weight of sample remaining on 60 mesh sieve})}{(\text{Weight of sample put on the sieve})} \times 100 + \frac{(\text{Weight of sample remaining on 100 mesh seive}) \times 3/5}{(\text{Weight of sampleput on the sieve})} \times 100 + \frac{(\text{Weight of sample remaining on 200 mesh sieve}) \times 1/5}{(\text{Weight of sample putonthesieve})} \times 100$$

When the values of fluidity are in the range of from 0 to less than 70; the fluidity was evaluated as "A"; from 70 to less than 80, as "AB"; from 80 to less than 90, as "B"; from 90 to less than 95, as "BC"; and 95 or more, as "C".

Figure 4:
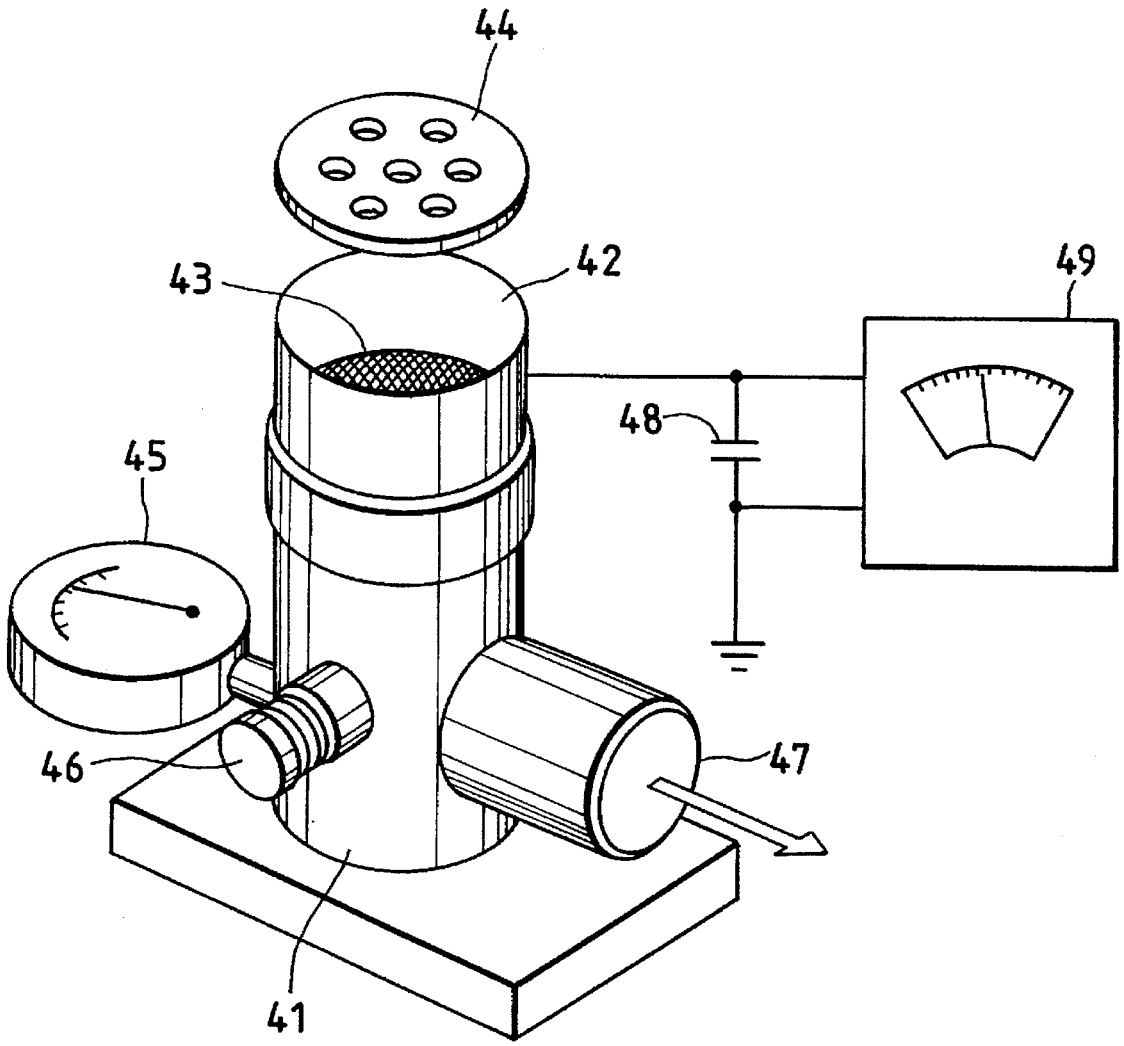
FIG. 4 illustrates a device used to measure the quantity of triboelectricity.

(6) Evaluation of charging rate:

A sample for measuring the quantity of triboelectricity is obtained by mixing 1 g of a magnetic toner and 9 g of an iron powder carrier having passed a 250 mesh sieve and remained on a 350 mesh sieve, followed by shaking. The sample is weighted, and put in, as shown in FIG. 4, a measuring container 42 made of metal having at its bottom a conducting screen 43 of 500 meshes or the one the magnetic particles can not pass, and the container is covered with a plate 44 made of metal. The total weight of the measuring container 42 in this state is weighed and is expressed by $W_1$ (g). Next, in a suction device 41 (made of an insulating material at least at the part coming into contact with the measuring container 42), air is sucked from a suction opening 47 and an air-flow control valve 46 is operated to control the pressure indicated by a vacuum indicator 45 to be 250 mmAq. In this state, suction is sufficiently carried out (for about 2 minutes) to remove the toner by suction. The potential indicated by a potentiometer 49 at this time is expressed by V (volt). In the drawing, reference numeral 48 denotes a capacitor, the capacitance of which is expressed by C (μF). The total weight of the measuring container after completion of the suction is also weighed and is expressed by $W_2$ (g). The quantity of triboelectricity T (μC/g) is calculated as shown by the following expression.

$$T(\mu C/g)=(C\times V)/(W_1-W_2)$$

The relationship between shaking time and the quantity of triboelectricity was determined, and when the shaking time for the quantity of triboelectricity to reach a saturated value was within 90 seconds, it was evaluated as "A"; within 150 seconds, as "AB"; within 210 seconds, as "B"; within 270 seconds, as BC; and more than that, as "C".

(7) Measurement of quantity of triboelectricity:

In the present invention, the quantity of triboelectricity of the magnetic toner present on the developing sleeve was measured by the suction type Faraday's gauging method.

The suction type Faraday's gauging method is a method as described below. An external cylinder of the device is pressed against the surface of the developing sleeve to suck up all the magnetic toner in a given area on the developing sleeve 1 collecting the sucked magnetic toner on a filter of an inner cylinder. The weight of the sucked magnetic toner can be calculated from the gain of the filter weight. At the same time, the quantity of charges accumulated in the internal cylinder electrostatically insulated from the outside is measured to determine the quantity of triboelectricity of the magnetic toner present on the developing sleeve.

MAGNETIC FINE PARTICLES

PRODUCTION EXAMPLE 10

First, 65 liters of an aqueous ferrous sulfate solution containing 1.5 mol/liter of $Fe^{2+}$ and 88 liters of an aqueous 2.4N sodium hydroxide solution were mixed and stirred.

Residual sodium hydroxide in the mixed aqueous solution was adjusted so as to be in a concentration of 4.2 g/liter. Thereafter, while maintaining the temperature at 80° C., 30 liter/minute of air was blown into the solution to interrupt the reaction.

Next, zinc sulfate was added in an aqueous ferrous sulfate solution containing 1.3 mol/liter of $Fe^{2+}$, to prepare 2.25 liters of an aqueous solution containing $Zn^{2+}$ in a concentration of 0.5 mol/liter, which was added to the above reaction slurry. Then, 15 liter/minute of air was blown into it to conclude the reaction.

The magnetic fine particles thus obtained were treated through conventional steps of washing, filtration, drying and disintegration.

Properties of the magnetic fine particles are shown in Table 4.

The magnetic fine particles thus obtained has thin films of iron-zinc ferrite on their surfaces and magnetite at their cores.

MAGNETIC FINE PARTICLES

PRODUCTION EXAMPLES 11 to 16

Production Example 10 was repeated except for changing the amount of zinc and the reaction conditions, to give magnetic fine particles having the properties as shown in Table 4.

MAGNETIC FINE PARTICLES

COMPARATIVE PRODUCTION EXAMPLE 5

Production Example 10 was repeated except for adding no zinc, to give magnetic fine particles having the properties as shown in Table 4.

MAGNETIC FINE PARTICLES

COMPARATIVE PRODUCTION EXAMPLES 6 to 9

Production Example 10 was repeated except for changing the amount of zinc added, the manner of addition, the pH of the reaction system, the reaction time and the reaction temperature, to give magnetic fine particles having the properties as shown in Table 4.

TABLE 4

| | Properties of Magnetic Fine Particles | | | | | | | | |
|---|---|---|---|---|---|---|---|---|---|
| | Magnetic properties | | | | | Zinc | | | |
| | Saturation magnetization σs ($Am^2/kg$) | Residual magnetization σr ($Am^2/kg$) | Coercive force Hc (KA/m) | The product of σr and Hc (σr × Hc) | Total zinc-content (%)* | content until 10% dissolution of iron element (%)** | Average partcle diameter (μm) | Shape | Resistivity (Ω · cm) |
| Production Example: | | | | | | | | | |
| 10 | 61.2 | 13.0 | 10.2 | 133 | 1.4 | 82 | 0.20 | Octahedron | $1.0 \times 10^3$ |
| 11 | 57.0 | 15.8 | 13.0 | 205 | 1.6 | 75 | 0.16 | Octahedron | $9.1 \times 10^2$ |
| 12 | 63.0 | 10.2 | 8.1 | 83 | 0.2 | 84 | 0.21 | Octahedron | $1.2 \times 10^3$ |
| 13 | 53.0 | 9.5 | 7.5 | 71 | 1.2 | 78 | 0.22 | Octahedron | $8.7 \times 10^2$ |
| 14 | 60.0 | 16.7 | 13.2 | 220 | 1.3 | 70 | 0.15 | Octahedron | $8.5 \times 10^2$ |
| 15 | 61.2 | 12.6 | 10.2 | 129 | 0.07 | 85 | 0.20 | Octahedron | $2.0 \times 10^3$ |
| 16 | 58.0 | 11.5 | 9.0 | 104 | 2.5 | 72 | 0.19 | Octahedron | $7.0 \times 10^2$ |
| Comparative Production Example: | | | | | | | | | |
| 5 | 65.5 | 14.0 | 12.0 | 168 | — | — | 0.20 | Octahedron | $4.6 \times 10^4$ |
| 6 | 67.5 | 17.5 | 15.5 | 271 | 1.0 | 80 | 0.08 | Octahedron | $9.2 \times 10^2$ |
| 7 | 67.5 | 8.0 | 5.6 | 45 | 5.0 | 62 | 0.20 | Octahedron | $4.0 \times 10^2$ |
| 8 | 49.5 | 8.2 | 5.9 | 48 | 10.0 | 30 | 0.85 | Octahedron | $1.0 \times 10^2$ |
| 9 | 68.4 | 8.5 | 6.0 | 51 | 4.0 | 55 | 0.21 | Sphere | $4.5 \times 10^2$ |

*based on total iron element
**based on total zinc element

EXAMPLE 11

Polyester resin 100 parts (obtained by condensation polymerization of terephthalic acid, fumaric acid, succinic acid, the bisphenol represented by Formula (I), having an ethylene group, and the bisphenol represented by Formula (I), having a propylene group; acid value: 25; OH value: 10; Mn: 4,500; Mw: 65,000; Tg: 58° C.)

Magnetic fine particles in Production Example 1 100 parts

Low-molecular weight ethylene-propylene copolymer (release agent) 3 parts

Monoazo metal complex (negative charge control agent) 1 part

The above materials were thoroughly premixed using a Henschel mixer, and then melt-kneaded at 130° C. using a twin-screw extruder. The kneaded product thus obtained was cooled, and then crushed with a cutter mill. Thereafter the crushed product was finely pulverized by means of a fine grinding mill making use of a jet stream. Subsequently, the finely pulverized powder obtained was classified using an air classifier to obtain a negatively chargeable insulating magnetic toner with a weight average particle diameter of 6.2 μm. To 100 parts of the magnetic toner thus obtained, 1.0 part of hydrophobic dry fine silica particles (BET surface specific area: 300 $m^2/g$) were externally added using a Henschel mixer to obtain a negatively chargeable magnetic toner having the hydrophobic dry fine silica particles on the magnetic toner particle surfaces.

The magnetic toner thus obtained was applied to a digital copying machine (GP-55) (manufactured by Canon Inc.), and images were reproduced in the same manner as in Example 1 to make an evaluation.

Results obtained are shown in Table 6.

EXAMPLE 12

A magnetic toner was obtained in the same manner as in Example 11 except that the polyester resin was replaced with 100 parts of a styrene/butyl acrylate copolymer (Mn: 12,000; Mw: 250,000; having peaks at 7,000 and 330,000 in its molecular weight distribution; Tg: 58° C.).

The magnetic toner obtained was tested in the same manner as in Example 1 to make an evaluation.

Results obtained are shown in Table 6.

EXAMPLES 13 to 18

Magnetic toners were obtained in the same manner as in Example 11 except for changing the compositions of magnetic toners to the compositions shown in Table 5. These magnetic toners obtained were tested in the same manner as in Example 1 to make an evaluation.

Results obtained are shown in Table 6.

COMPARATIVE EXAMPLES 5 to 9

Magnetic toners were obtained in the same manner as in Example 11 except for changing the compositions of magnetic toners to the compositions shown in Table 5. These magnetic toners obtained were tested in the same manner as in Example 1 to make an evaluation.

Results obtained are shown in Table 6.

TABLE 5

| Binder resin | Magnetic fine particles | Magnetic toner weight average particle diameter (μm) |
|---|---|---|
| Example: | | |
| 11 Polyester resin | Production Example 10 | 6.2 |
| 12 Styrene/butyl acrylate copolymer | Production Example 10 | 6.2 |
| 13 Polyester resin | Production Example 11 | 6.5 |
| 14 Polyester resin | Production Example 12 | 6.3 |
| 15 Polyester resin | Production Example 13 | 6.6 |
| 16 Polyester resin | Production Example 14 | 6.4 |
| 17 Polyester resin | Production Example 15 | 6.0 |
| 18 Polyester resin | Production Example 16 | 6.3 |
| Comparative Example: | | |
| 5 Polyester resin | Comp. Production Ex. 5 | 6.2 |
| 6 Polyester resin | Comp. Production Ex. 6 | 6.5 |
| 7 Polyester resin | Comp. Production Ex. 7 | 6.4 |
| 8 Polyester resin | Comp. Production Ex. 8 | 6.6 |
| 9 Polyester resin | Comp. Production Ex. 9 | 6.8 |

TABLE 6(A)

| | Results of Evaluation | | | | | | | |
|---|---|---|---|---|---|---|---|---|
| | After 10,000 sheet copying in N/L environment | | | | | | | |
| | Quan-* tity of | Solid | | | Halftone area | | | |
| | tribo-elec- | black area | Den-sity | Line image | Image quality | | White back- | Photosensitive drum |
| | tricity (μC/g) | maximum density | grada-tion | qual-ity | (coarse-ness) | Tinge | ground fog | Abration (μm) Scratch |
| Example: | | | | | | | | |
| 11 | −17.0 | A (1.48) | A | A | A | A (Black) | A | A (1.5) A (None) |
| 12 | −18.0 | A (1.45) | A | A | A | A (Black) | AB | A (1.7) A (None) |
| 13 | −20.0 | A (1.47) | A | A | A | A (Black) | A | A (1.5) A (None) |
| 14 | −20.0 | A (1.46) | A | A | A | A (Black) | A | A (1.8) A (None) |
| 15 | −16.0 | AB (1.38) | AB | A | A | A (Black) | AB | A (1.7) A (None) |
| 16 | −18.0 | AB (1.38) | AB | A | A | A (Black) | A | A (1.6) A (None) |
| 17 | −16.0 | AB (1.37) | AB | A | A | A (Black) | AB | A (1.7) A (None) |
| 18 | −15.0 | A (1.42) | A | A | A | AB (Slightly yellowish) | A | A (1.8) A (None) |
| Comparative Example: | | | | | | | | |
| 5 | −28.0 | B (1.30) | BC | B | BC | A (Black) | BC | AB (2.2) A (None) |
| 6 | −4.5 | B (1.30) | BC | B | BC | A (Black) | A | AB (2.3) A (None) |
| 7 | −4.0 | A (1.42) | A | BC | BC | BC (Yellowish) | C | AB (2.4) A (None) |
| 8 | −4.0 | B (1.30) | BC | B | BC | C (Yellowish) | C | AB (2.3) A (None) |
| 9 | −3.0 | B (1.32) | BC | AB | BC | BC (Yellowish) | C | C (3.8) C (5 lines) |

*of magnetic toner

TABLE 6(B)

| | Results of Evaluation | | | | | | | |
|---|---|---|---|---|---|---|---|---|
| | Evaluation of initial image quality after leaving for a week in H/H environment | | | | | | | |
| | Quantity of triboelectricity (μC/g)* | Solid black area maximum density | Density gradation | Line image quality | Halftone area image quality | White background fog | Properties of magnetic toner: Fluidity | Properties of magnetic toner: Charging Rate |
| Example: | | | | | | | | |
| 11 | −12.5 | A (1.44) | A | A | A | A | AB | AB |
| 12 | −13.5 | A (1.42) | A | A | A | A | AB | AB |
| 13 | −15.0 | A (1.43) | A | A | A | A | AB | AB |
| 14 | −16.0 | A (1.42) | A | A | A | A | AB | AB |
| 15 | −13.0 | AB (1.36) | AB | A | AB | A | AB | AB |
| 16 | −12.5 | AB (1.36) | AB | A | A | A | AB | AB |
| 17 | −12.0 | A (1.40) | A | A | A | A | AB | AB |
| 18 | −12.0 | AB (1.38) | AB | A | A | A | AB | AB |
| Comparative Example: | | | | | | | | |
| 5 | −4.0 | B (1.25) | BC | B | BC | B | BC | BC |
| 6 | −3.0 | B (1.24) | BC | B | BC | A | BC | BC |
| 7 | −1.5 | AB (1.35) | B | B | BC | B | BC | BC |
| 8 | −1.0 | BC (1.15) | C | C | C | B | BC | BC |
| 9 | −1.0 | AB (1.35) | B | B | BC | B | BC | BC |

*of magnetic toner

What is claimed is:

1. A magnetic toner comprising a binder resin and magnetic fine particles, wherein;

said magnetic fine particles are coated with an iron-zinc oxide on their surfaces; and said magnetic fine particles have a saturation magnetization (σs) of 50 $Am^2/kg$ or above under a magnetic field of 79.58 kA/m (1K oersted); the product of residual magnetization (σr, $Am^2/kg$) and coercive force (Hc, kA/m), σr×Hc, being in the range between 60 and 250 ($kA^2m/kg$).

2. The magnetic toner according to claim 1, wherein, in said magnetic fine particles, the total content of the zinc element is from 0.05 by weight to 3% by weight based on the total iron element constituting the magnetic fine particles.

3. The magnetic toner according to claim 2, wherein, in said magnetic fine particles, the total content of the zinc element is from 0.1% by weight to 1.6% by weight based on the total iron element constituting the magnetic fine particles.

4. The magnetic toner according to claim 1, wherein, in said magnetic fine particles, the content of the zinc element that is present in the portion of which dissolution of the iron element is up to 10% by weight is not less than 60% by weight of the total zinc element content.

5. The magnetic toner according to claim 4, wherein, in said magnetic fine particles, the content ratio of the zinc element that is present in the portion of which dissolution of the iron element is up to 10% by weight is not less than 70% by weight of the total zinc element content.

6. The magnetic toner according to claim 1, wherein said magnetic fine particles have a saturation magnetization (σs) of 55 $Am^2/kg$ or above under a magnetic field of 79.58 kA/m (1K oersted); the product of residual magnetization (σr, $Am^2/kg$) and coercive force (Hc, kA/m), σr×Hc, being in the range between 80 and 210 ($kA^2m/kg$).

7. The magnetic toner according to claim 1, wherein said magnetic fine particles have the shape of hexahedrons or octahedrons.

8. The magnetic toner according to claim 1, wherein said magnetic fine particles have an average particle diameter of from 0.05 μm to 0.35 μm.

9. The magnetic toner according to claim 8, wherein said magnetic fine particles have an average particle diameter of from 0.1 μm to 0.3 μm.

10. The magnetic toner according to claim 1, wherein said magnetic fine particles have a residual magnetization (σr) of from 5 $Am^2/kg$ to 20 $Am^2/kg$.

11. The magnetic toner according to claim 1, wherein said magnetic fine particles have a coercive force (Hc) of from 6 kA/m to 16 kA/m.

12. The magnetic toner according to claim 1, wherein said magnetic fine particles have a residual magnetization (σr) of from 8 $Am^2/kg$ to 18 $Am^2/kg$.

13. The magnetic toner according to claim 11, wherein said magnetic fine particles have a coercive force (Hc) of from 8 kA/m to 14 kA/m.

14. The magnetic toner according to claim 12, wherein said magnetic fine particles have a residual magnetization (σr) of from 10.1 $Am^2/kg$ to 17 $Am^2/kg$.

15. The magnetic toner according to claim 1, wherein, in said magnetic fine particles;

the total content of the zinc element is from 0.05% by weight to 3% by weight based on the total iron element constituting the magnetic fine particles;

the content of the zinc element that is present in the portion of which dissolution of the iron element is up to 10% by weight, is not less than 60% by weight of the total zinc element content;

the saturation magnetization (σs) is 50 $Am^2/kg$ or above;

the residual magnetization (σr) is from 5 $Am^2/kg$ to 20 50 $Am^2/kg$; and the coercive force (Hc) is from 6 kA/m to 16 kA/m.

16. The magnetic toner according to claim 15, wherein said magnetic fine particles have the shape of octahedrons and have an average particle diameter of from 0.05 μm to 0.35 μm.

17. The magnetic toner according to claim 16, wherein said magnetic fine particles have an average particle diameter of from 0.1 μm to 0.3 μm.

18. The magnetic toner according to claim 15, wherein said magnetic fine particles have the shape of hexahedrons and have an average particle diameter of from 0.05 μm to 0.35 μm.

19. The magnetic toner according to claim 18, wherein said magnetic fine particles have an average particle diameter of from 0.1 μm to 0.3 μm.

20. The magnetic toner according to claim 1, wherein, in said magnetic fine particles, the content of the zinc element that is present in the portion of which dissolution of the iron element is up to 10% by weight, is not less than 60% by weight of the total zinc element content, the content of the silicon element that is present in the portion of which dissolution of the iron element is not more than 10% by weight, is not less than 70% by weight of the total silicon element content, and the silicon element is in a content larger than the content of the zinc element.

21. The magnetic toner according to claim 20, wherein, in said magnetic fine particles, the total content of the zinc element is from 0.05 by weight to 3% by weight based on the total iron element constituting the magnetic fine particles.

22. The magnetic toner according to claim 20, wherein, in said magnetic fine particles, the total content of the zinc element is from 0.08 by weight to 2% by weight based on the total iron element constituting the magnetic fine particles.

23. The magnetic toner according to claim 22, wherein, in said magnetic fine particles, the total content of the zinc element is from 0.1% by weight to 1.6% by weight based on the total iron element constituting the magnetic fine particles.

24. The magnetic toner according to claim 20, wherein, in said magnetic fine particles, the total content of the silicon element is from 0.01% by weight to 3% by weight based on the total iron element constituting the magnetic fine particles.

25. The magnetic toner according to claim 24, wherein, in said magnetic fine particles, the total content of the silicon element is from 0.05 % by weight to 2% by weight based on the total iron element constituting the magnetic fine particles.

26. The magnetic toner according to claim 20, wherein the content of the zinc element that is present in the portion of which dissolution of the iron element is up to 10% by weight, is not less than 70% by weight of the total zinc element content, the content of the silicon element that is present in the portion of which dissolution of the iron element is up to 10% by weight, is not less than 80% by weight of the total silicon element content, and the silicon element is in a content larger than the content of the zinc element.

27. The magnetic toner according to claim 20, wherein said magnetic fine particles have a saturation magnetization ($\sigma s$) of 55 $Am^2/kg$ or above under application of a magnetic field of 79.58 kA/m (1K oersted); the product of residual magnetization ($\sigma r$ $Am^2/kg$) and coercive force (Hc, kA/m), $\sigma r \times Hc$, being in the range between 80 and 210 ($kA^2m/kg$).

28. The magnetic toner according to claim 20, wherein said magnetic fine particles have the shape of octahedrons.

29. The magnetic toner according to claim 20, wherein said magnetic fine particles have the shape of hexahedrons.

30. The magnetic toner according to claim 20, wherein said magnetic fine particles have an average particle diameter of from 0.05 μm to 0.35 μm.

31. The magnetic toner according to claim 30, wherein said magnetic fine particles have an average particle diameter of from 0.1 μm to 0.3 μm.

32. The magnetic toner according to claim 20, wherein said magnetic fine particles have a residual magnetization ($\sigma r$) of from 5 $Am^2/kg$ to 20 $Am^2/kg$.

33. The magnetic toner according to claim 32, wherein said magnetic fine particles have a residual magnetization ($\sigma r$) of from 8 $Am^2/kg$ to 18 $Am^2/kg$.

34. The magnetic toner according to claim 20, wherein said magnetic fine particles have a coercive force (Hc) of from 6 kA/m to 16 kA/m.

35. The magnetic toner according to claim 34, wherein said magnetic fine particles have a coercive force (Hc) of from 8 kA/m to 14 kA/m.

36. An image forming method comprising;

forming an electrostatic image on a electrostatic latent image bearing member;

forming on the electrostatic latent image bearing member a developer layer having a magnetic toner;

triboelectrically charging the magnetic toner;

causing the magnetic toner having triboelectric charges, to move to the surface of the electrostatic latent image bearing member to form a toner image on the electrostatic latent image bearing member;

transferring the toner image to a transfer medium via, or not via, an intermediate transfer medium; and fixing the toner image formed on the transfer medium; wherein;

said magnetic toner comprises a binder resin and magnetic fine particles, wherein;

said magnetic fine particles are coated with an iron-zinc oxide on their surfaces; and said magnetic fine particles have a saturation magnetization ($\sigma s$) of 50 $Am^2/kg$ or above under application of a magnetic field of 79.58 kA/m (1K oersted); the product of residual magnetization ($\sigma r$, $Am^2/kg$) and coercive force (Hc, kA/m), $\sigma r \times Hc$, being in the range between 60 and 250 ($kA^2m/kg$).

37. The method according to claim 36, wherein said electrostatic image is a digital latent image.

38. The method according to claim 36, wherein said magnetic toner is triboelectrically charged so as to provide a negative triboelectrically charged image.

39. The method according to claim 36, wherein said electrostatic image is developed by reversal development using the magnetic toner.

40. The method according to claim 36, wherein said magnetic toner is the magnetic toner described in any one of claims 2 to 35.

* * * * *